US006334558B1

(12) United States Patent
Sher

(10) Patent No.: US 6,334,558 B1
(45) Date of Patent: Jan. 1, 2002

(54) HANGER SUPPORT WITH HORIZONTALLY DISPOSED GARMENT HANGING GROOVES

(76) Inventor: Yuh Yi Sher, 7FL. Block B, No. 58, Sec. 1, Min Sheng E. Road, Taipei (TW)

( * ) Notice: Subject to any disclaimer, the term of this patent is extended or adjusted under 35 U.S.C. 154(b) by 0 days.

(21) Appl. No.: 09/854,629

(22) Filed: May 15, 2001

(51) Int. Cl.[7] ..... A41H 43/00

(52) U.S. Cl. ..... 223/1; 206/290; 206/300; 211/124

(58) Field of Search ..... 223/1, DIG. 2; 206/289, 290, 300, 288; 211/124

(56) References Cited

U.S. PATENT DOCUMENTS 5,590,765 A * 1/1997 London ..... 206/289
5,782,367 A * 7/1998 Aumasson ..... 211/124
5,887,710 A 3/1999 London et al. ..... 206/289
5,944,178 A * 8/1999 Mao ..... 206/278

* cited by examiner

*Primary Examiner*—Bibhu Mohanty
(74) *Attorney, Agent, or Firm*—Dougherty & Troxell

(57) ABSTRACT

A hanger support comprises a base comprising a projection, a horizontal member above the base having a plurality of hanging grooves on the bottom thereof, a vertical member coupled between the horizontal member and the base, a slot at the other end of the horizontal member having a guide and an end recess, and a flexible first protuberance; a pivotal engagement mechanism comprising an outer knob, a body having a first and second pivot ends, a flexible second protuberance, a first dent, and a second dent; a pin for pivotably securing the engagement mechanism to the base; and a pad member on the bottom of the body; wherein the engagement mechanism is rotatable to dispose horizontally for providing a space for inserting a hanger between the pad member and the horizontal member in an unlocked state; and the engagement mechanism is further rotatable to dispose vertically for clamping the hanger.

2 Claims, 7 Drawing Sheets

HANGER SUPPORT WITH HORIZONTALLY DISPOSED GARMENT HANGING GROOVES

BACKGROUND OF THE INVENTION

1. Field of the Invention

The present invention relates to hanger supports and more particularly to a hanger support with horizontally disposed garment hanging grooves.

2. Description of Related Art

Conventionally, a garment is hung on a hanger to keep it in shape. However, such supported garments may be messy if there is no hanger support provided for hangers. U.S. Pat. No. 5,887,710 entitled "Garment Bag And Hanger Support" shown in FIG. 10 is disclosed for providing a solution to above problem. As shown, a limiting pin 7 having two enlarged head ends is passed through near one ends of clamp jaws 3 and 4 to define the open degree of pivotably coupled clamp jaws 3 and 4. Two facing resilient blocks 5 and 6 are provided on clamp jaws 3 and 4 respectively. A latching device 8 is pivotably provided on the other end of clamp jaw 4. A link 9 on latching device 8 is operable to fasten clamp jaws 3 and 4 together so that garments already hung between resilient blocks 5 and 6 may be secured by the clamping effect of resilient blocks 5 and 6. Further, a mount structure or bracket 2 is coupled between clamp jaw 3 and upper wall 1.

But this is unsatisfactory for the purpose for which the invention is concerned for the following reasons: As being limited by the length of limiting pin 7, both the open degree of clamp jaws 3 and 4 (i.e., angle therebetween) as well as that of resilient blocks 5 and 6 are small. The gap near the pivot ends of clamp jaws 3 and 4 is particularly small. This may hinder the hanging of hanger on hanger support. Further, hanger hanging operation in hanger support is not smooth since latching device 8 and link 9 are provided on the path of above hanger hanging operation (i.e., somewhat hindered). Furthermore as the most important disadvantageous factor, the total weight of hung hangers are borne on clamp jaw 4 which is only supported by limiting pin 7. In hanger hanging operation, after all hangers having hung garments are placed on resilient block 6, user has to exert a significant force to lift clamp jaw 4 sufficiently to secure latching device 8, link 9 and clamp jaws 3 and 4 together in order to clamp hangers between resilient blocks 5 and 6. In view of above, improvement with respect to hanger support still exists.

SUMMARY OF THE INVENTION

It is an object of the present invention to provide a hanger support comprising a base, a pivotal engagement mechanism, a pin, and a pad member wherein the base is pivotably secured to one side of the engagement mechanism. When the engagement mechanism is disposed horizontally by rotation, a large hanger receiving space is formed in each of hanging grooves for facilitating the accessing of hanger. When the engagement mechanism is disposed horizontally by rotation, a hanger may be clamped between the pad member on the engagement mechanism and the hanging groove. Moreover, a torque is generated in rotating the engagement mechanism for facilitating the fastening/unfastening of a hanger.

It is another object of the present invention to provide a hanger support wherein the engagement mechanism comprises a protuberance and the base comprises a recess in an open end for securing the protuberance in a locked position.

It is still another object of the present invention to provide a hanger support wherein the base and the hanger grooves are formed integrally for fastening hangers rested on the hanger grooves. In use, simply insert hangers onto the hanger grooves. Thereafter, rotate the engagement mechanism to secure the hangers. This eliminate prior art problem of exerting a great force to lift hanger with hung clothes to a sufficient height prior to securing thereto.

It is still another object of the present invention to provide a hanger support comprising a base, a pivotal engagement mechanism, a pin, and a pad member so as to effect a simple construction as compared with prior art.

It is a further object of the present invention to provide a hanger support wherein the base comprises a flexible first protuberance on the open end and the engagement mechanism comprises a first dent and a second dent so that the engagement mechanism is rotatable to dispose either horizontally for causing the first protuberance to engage with the second dent or vertically for causing the first protuberance to engage with the first dent.

To achieve the above and other objects, the present invention provide a hanger support comprising a base comprising an elongate hollow projection on the top, a horizontal member above the base having a plurality of hanging grooves on the bottom thereof, a vertical member having a hole coupled between one end of the horizontal member and one side of the base being spaced from the projection, a slot at the other end of the horizontal member having a guide and an end recess, and a flexible first protuberance on the edge opposite to the vertical member; a pivotal engagement mechanism comprising an outer knob, an elongate body having a first pivot end and a second pivot end each having a hole, a flexible second protuberance, a first dent, and a second dent; a pin inserted through the hole of the vertical member, the hole of the second pivot end, and the projection into the hole of the first pivot end to pivotably secure the engagement mechanism to the base; and a pad member on the bottom of the body; wherein the engagement mechanism is rotatable to dispose horizontally for causing the first protuberance to engage with the second dent for creating a hanger receiving space between the pad member and the horizontal member in an unlocked state of the hanger support; and the engagement mechanism is further rotatable to dispose vertically for causing the second protuberance to secure in the recess through the guide, the first protuberance to engage with the first dent, and a hanger to clamp between the pad member and the hanging groove. By utilizing this hanger support, the fastening/unfastening of a hanger is by simply turning the engagement mechanism. The above and other objects, features and advantages of the present invention will become apparent from the following detailed description taken with the accompanying drawings.

DETAILED DESCRIPTION OF THE PREFERRED EMBODIMENTS

Figure 1:
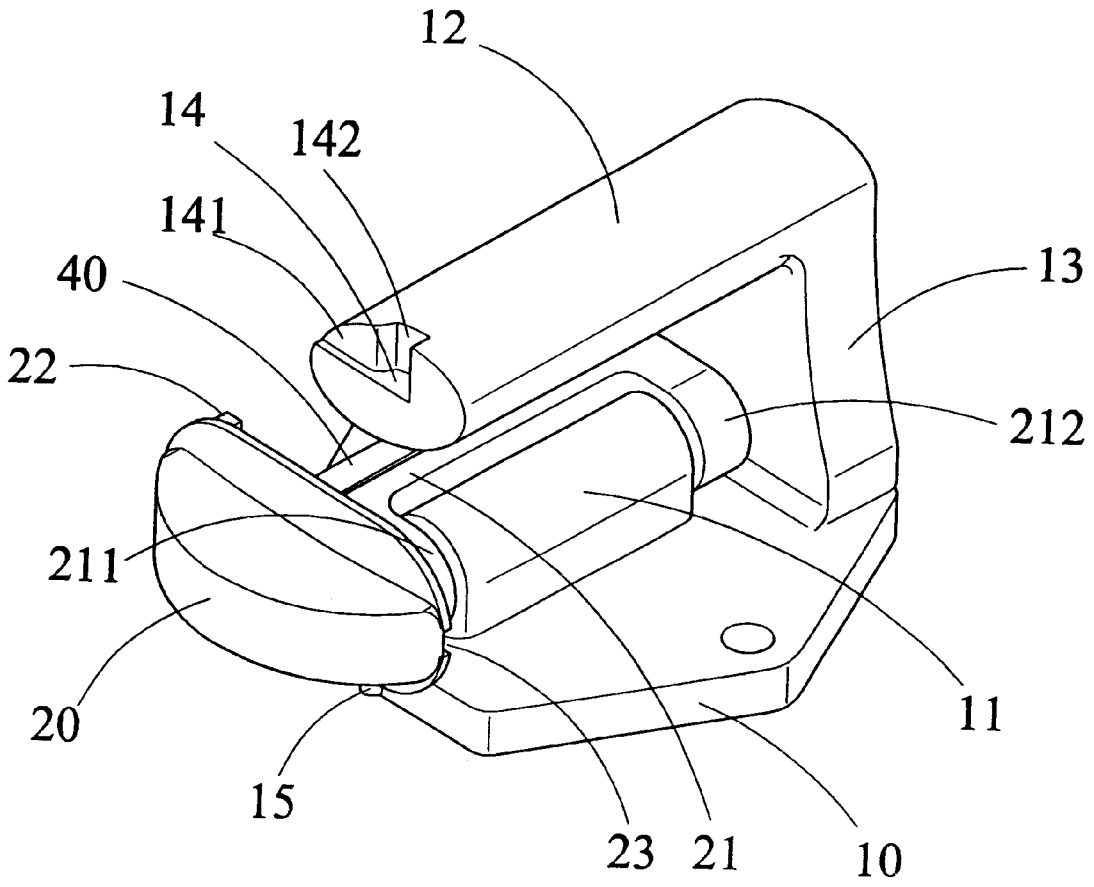
FIG. 1 is a perspective view of a hanger support with horizontally disposed garment hanging grooves according to the invention.
Figure 2:
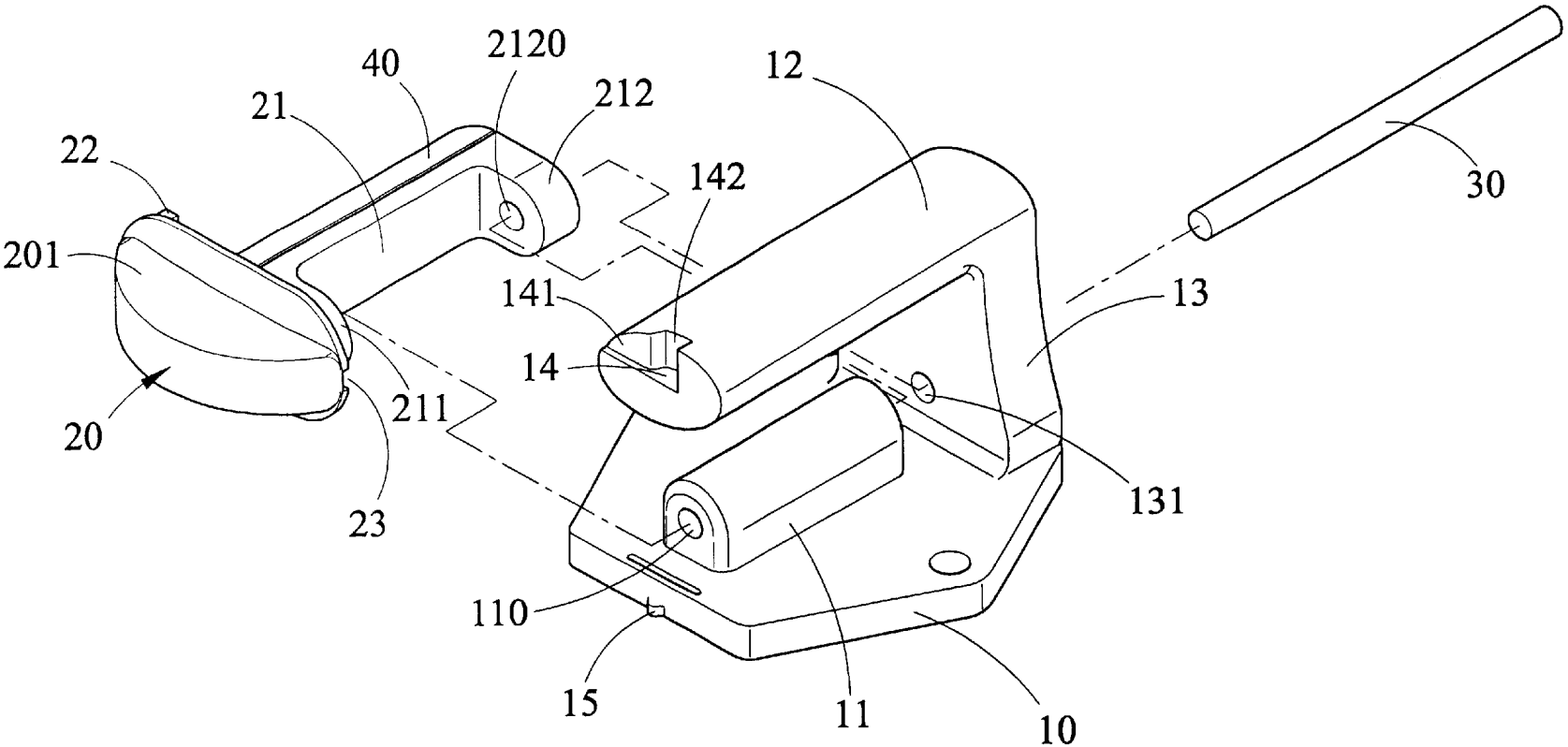
FIG. 2 is an exploded view of FIG. 1.

Referring to FIGS. 1 to 6, there is shown a hanger support constructed in accordance with the invention comprising a base 10, a pivotal engagement mechanism 20, a pin 30, and a pad member 40. Each of above components is detailed below. Base 10 comprises an elongate hollow projection 11 on the top, a horizontal member 12 above base 10 having a plurality of hanging grooves 121 on the bottom, a vertical member 13 having a through hole 131 coupled between one end of horizontal member 12 and one side of base 10 being spaced from projection 11, a slot 14 at the other end of horizontal member 12 having a guide 141 and an end recess 142, and a flexible protuberance 15 on the edge opposite to vertical member 13. Pivotal engagement mechanism 20 has an outer knob 201 for ease of turning by hand and comprises an elongate body 21 having a first pivot end 211 and a second pivot end 212 each having a hole, a flexible protuberance 22, a first dent 23, and a second dent 24 (see FIG. 4). Pin 30 is inserted through the hole 131 of vertical member 13, the hole 2120 of second pivot end 212, and the bore 110 of projection 11 into the hole (not shown) of first pivot end 211 to pivotably secure the engagement mechanism 20 to the base 10. Pad member 40 formed of elastomeric material is provided on the bottom of body 21.

Figure 3:
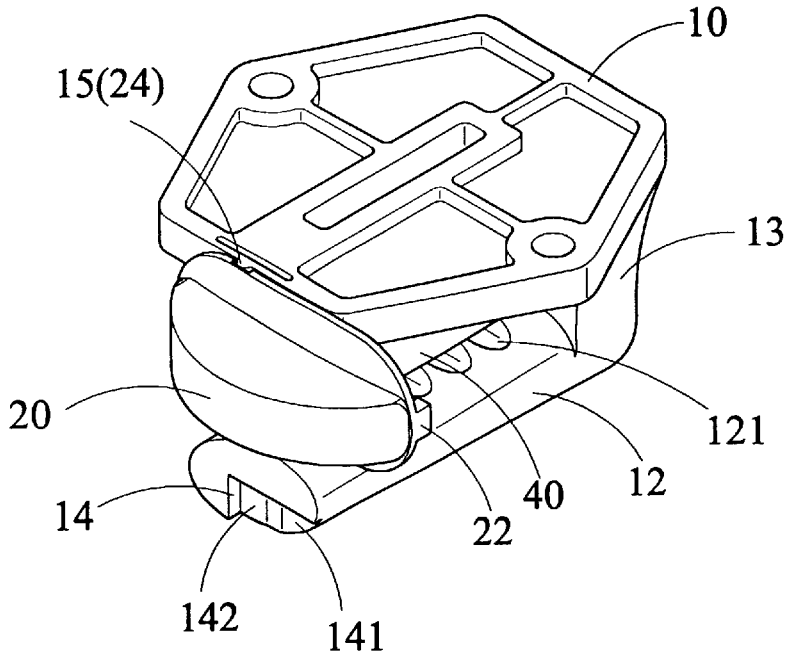
FIG. 3 is another perspective view of hanger support viewed in an angle reverse to that of FIG. 1 where hanger support is unlocked.
Figure 5:
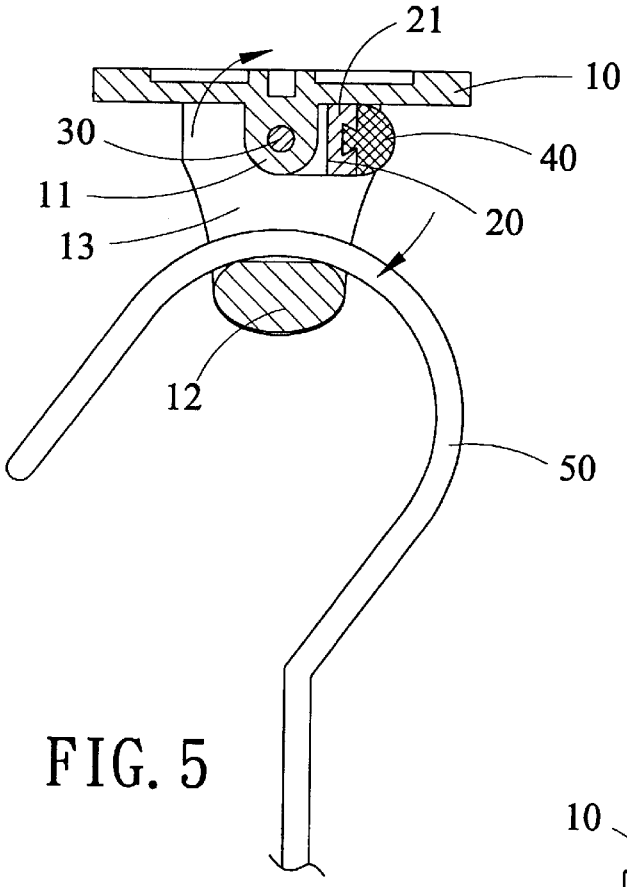
FIG. 5 is a partial sectional view of FIG. 3 where hanger is hung on a hanging groove but unlocked.

Referring to FIGS. 3 and 5 specifically, when pivotal engagement mechanism 20 is turned to be disposed horizontally, protuberance 15 is engaged with second dent 24. Further, a gap between pad member 40 and horizontal member 12 is relative large (see FIG. 5). Hence, it is easy to hang a hanger 50 on the hanging groove 121 (see FIG. 3). At this position, hanger support is unlocked.

Figure 4:
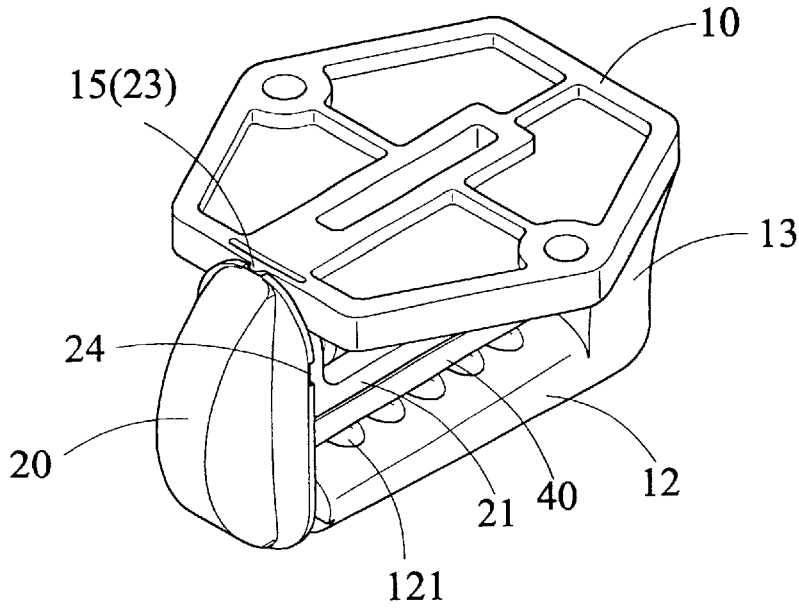
FIG. 4 is a view similar to FIG. 3 where hanger support is locked.
Figure 6:
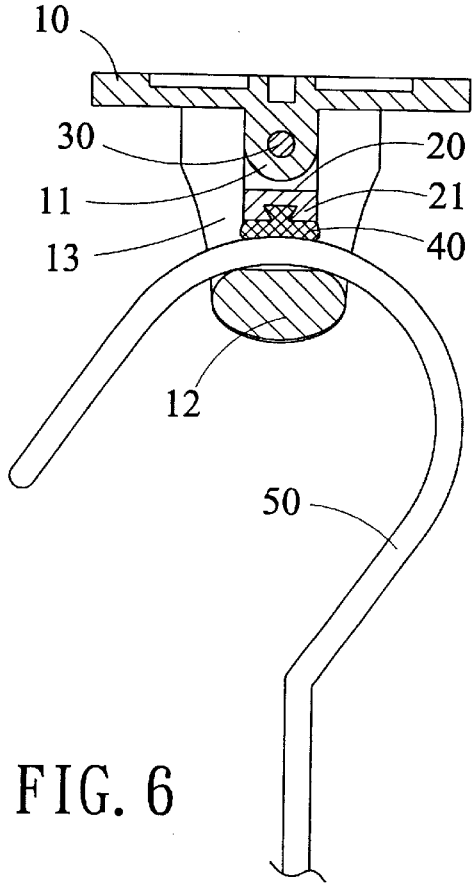
FIG. 6 is a view similar to FIG. 5 where hanger is locked.

Referring to FIGS. 4 and 6 specifically, when pivotal engagement mechanism 20 is again turned to be disposed vertically, protuberance 22 is secured in recess 142 through guide 141, protuberance 15 is engaged with first dent 23, and the hook portion of hanger 50 is clamped between pad member 40 and hanging groove 121 (see FIG. 4). In brief, the fastening/unfastening of hanger 50 is by simply turning pivotal engagement mechanism 20. Hence, it is much easy and labor saving.

Figure 7:
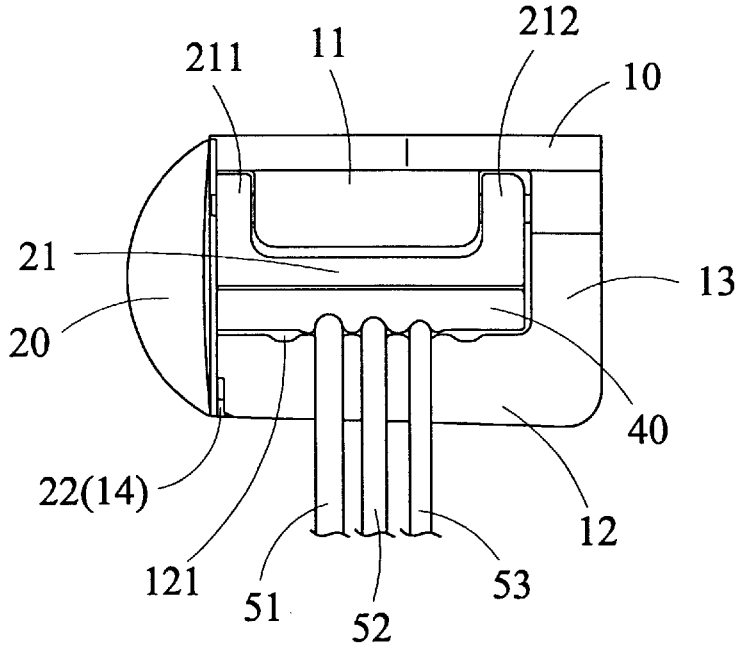
FIG. 7 is side view schematically showing hangers secured in hanger support.

Referring to FIG. 7, the hook portions of a plurality of hangers 51, 52 and 53, each having a diameter different from the other, are fastened by pad member 40 and horizontal member 12 since the provision of pad member 40 formed of elastomeric material as stated above.

Figure 8:
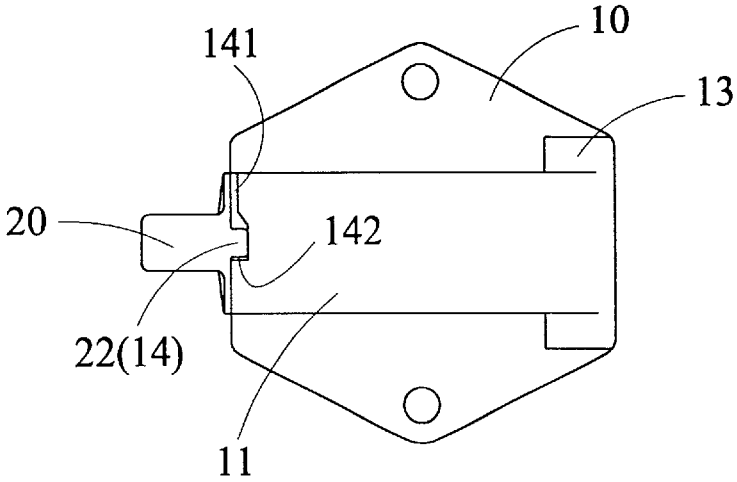
FIG. 8 is top plan view of the locked hanger support.

Referring to FIG. 8, there is shown protuberance 22 secured in recess 142 after passing through guide 141 of slot 14.

Figure 9:
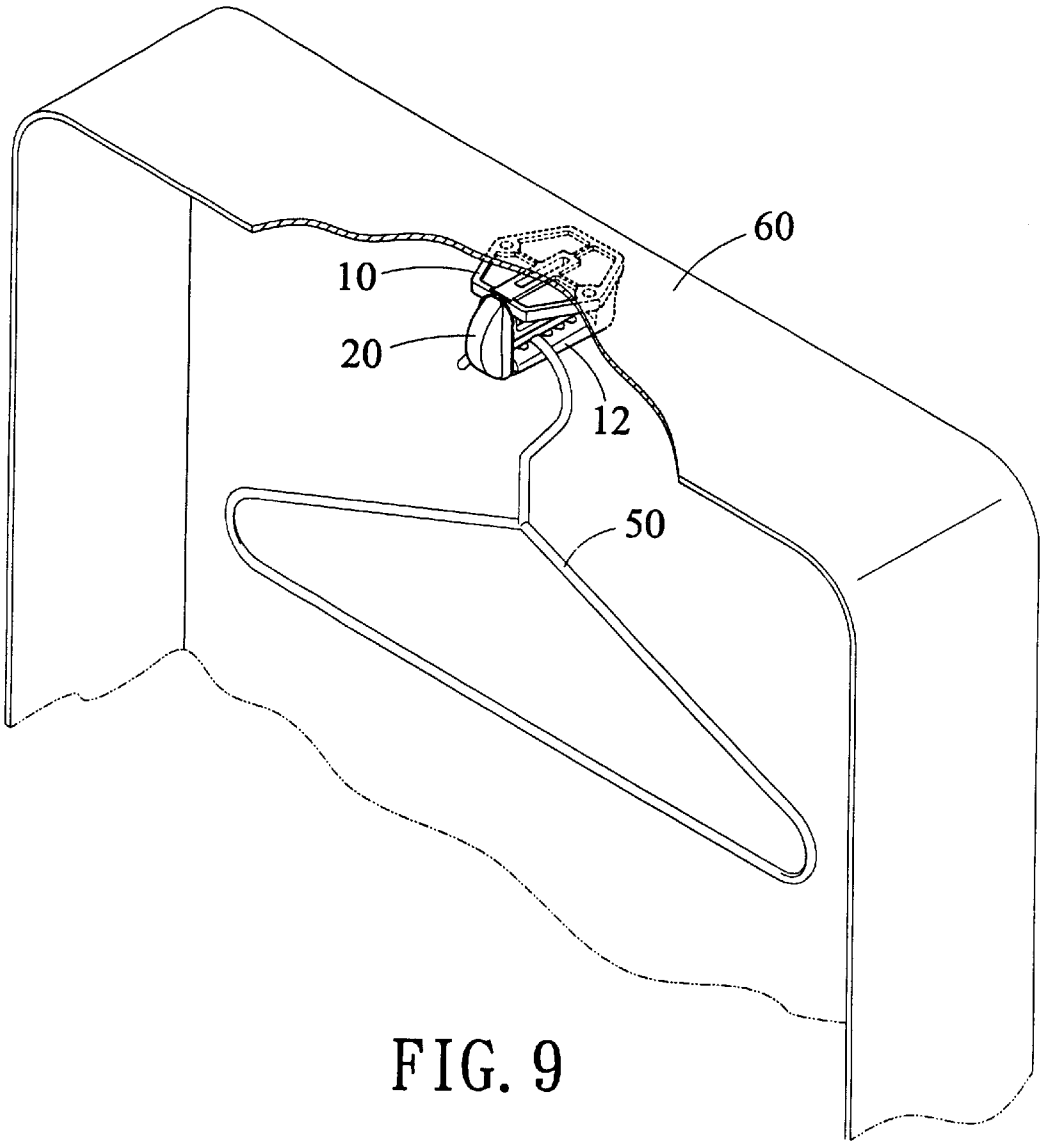
FIG. 9 is a perspective view of a hanger hung on the FIG. 1 hanger support mounted on a garment bag.
Figure 10:
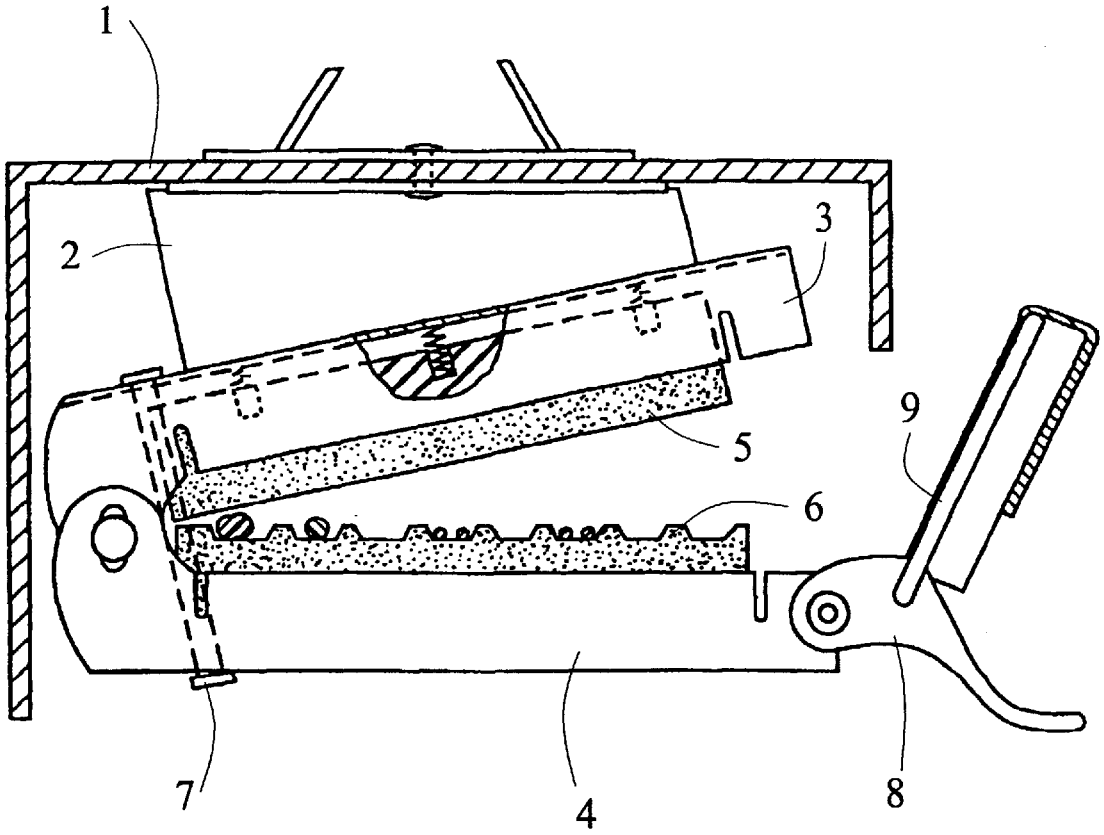
FIG. 10 PRIOR ART
FIG. 10 is a side view in part section of U.S. Pat. No. 5,887,710.

Referring to FIG. 9, a garment 50 is hung on the hanger support which is mounted on a garment bag 60 by securing base 10 thereto.

While the invention herein disclosed has been described by means of specific embodiments, numerous modifications and variations could be made thereto by those skilled in the art without departing from the scope and spirit of the invention set forth in the claims.

What is claimed is:

1. A hanger support device comprising:

a base (10) comprising an elongate hollow projection (11) on a top thereof having a through hole (110);

a horizontal member (12) above said base having a plurality of hanging grooves (121) on a bottom thereof;

a vertical member (13), having a hole (131), coupled between one end of said horizontal member (12) and one side of said base (10) being spaced from said projection (11);

a slot (14) at said other end of said horizontal member (12) having a guide (141) and an end recess (142); and a flexible first protuberance (15) on said edge opposite to said vertical member (13);

a pivotal engagement mechanism (20) comprising an outer knob (201), an elongate body (21) having a first pivot end (211) and a second pivot end (212) each having a hole, a flexible second protuberance (22), a first dent (23), and a second dent (24);

a pin (30) inserted through said hole (131) of said vertical member (13), said hole of said second pivot end (212), and said projection (11) into said hole of said first pivot end (211) to pivotably secure said engagement mechanism (20) to said base (10); and a pad member (40) on said bottom of said body (21);

wherein said engagement mechanism (20) is rotatable to dispose horizontally for causing said first protuberance (15) to engage with said second dent (24) for creating a hanger (50) receiving space between said pad member (40) and said horizontal member (12) in an unlocked state of said hanger support device; and said engagement mechanism (20) is further rotatable to dispose vertically for causing said second protuberance (22) to secure in said recess(14) through said guide (141), said first protuberance (15) to engage with said first dent (23), and a hung hanger (50) to clamp between said pad member (40) and said hanging groove (121).

2. The hanger support device of claim 1, wherein said pad member is formed of elastomeric material.

* * * * *